US008713727B2

(12) United States Patent
Heimbrock et al.

(10) Patent No.: US 8,713,727 B2
(45) Date of Patent: May 6, 2014

(54) SIDERAIL ASSEMBLY FOR PATIENT SUPPORT APPARATUS

(75) Inventors: Richard H. Heimbrock, Cincinnati, OH (US); Stephen E. Hutchison, Batesville, IN (US); Christopher R. O'Keefe, Batesville, IN (US); Brian T. Wiggins, Burlington, KY (US); Robert Mark Zerhusen, Cincinnati, OH (US)

(73) Assignee: Hill-Rom Services, Inc., Batesville, IN (US)

( * ) Notice: Subject to any disclaimer, the term of this patent is extended or adjusted under 35 U.S.C. 154(b) by 323 days.

(21) Appl. No.: 12/943,094

(22) Filed: Nov. 10, 2010

(65) Prior Publication Data

US 2012/0023666 A1 Feb. 2, 2012

Related U.S. Application Data

(60) Provisional application No. 61/369,324, filed on Jul. 30, 2010.

(51) Int. Cl.
*A47C 21/08* (2006.01)
*A61G 7/05* (2006.01)

(52) U.S. Cl.
CPC ..... *A61G 7/0507* (2013.01); *A61G 2007/0509* (2013.01); *A61G 2007/0524* (2013.01)
USPC ..... 5/430; 5/425; 5/662

(58) Field of Classification Search
CPC ..... A61G 7/0507; A61G 7/053; A61G 2007/0507; A61G 2007/0512; A61G 2007/0513; A61G 2007/0516; A61G 2007/0524
USPC ..... 5/424, 425, 428–430, 613, 617, 618, 5/662, 503.1, 507.1, 658, 663; 49/53, 56, 49/70, 460; 297/487
See application file for complete search history.

(56) References Cited

U.S. PATENT DOCUMENTS

| | | | | |
|---|---|---|---|---|
| 421,656 | A | 2/1890 | Blanken | |
| 1,279,120 | A | 12/1916 | Kellogg | |
| 1,778,698 | A | 10/1930 | Walter | |
| 1,862,237 | A * | 6/1932 | Pepler | 108/49 |
| 2,585,660 | A | 2/1952 | Kjos et al. | |
| 2,722,017 | A | 11/1955 | Burst et al. | |
| 2,817,854 | A | 12/1957 | Pratt | |
| 2,817,855 | A | 12/1957 | Pratt | |

(Continued)

FOREIGN PATENT DOCUMENTS

| | | |
|---|---|---|
| EP | 1693037 | 8/2006 |
| EP | 1816994 | 5/2011 |

(Continued)

OTHER PUBLICATIONS

English Abstract for DE 102006011852 (B3) 1 page, Jun. 6, 2007.

*Primary Examiner* — Nicholas Polito
(74) *Attorney, Agent, or Firm* — Barnes & Thornburg LLP

(57) ABSTRACT

A siderail assembly includes a guide, a support frame coupled to the frame and movable between first and second positions, and a barrier coupled to the support frame and movable therewith. The siderail assembly further includes a handle coupled to the barrier to move between a first position and a second position relative to the barrier. The siderail assembly may include electronic controls to change the position or limit movement of various portions of a patient support apparatus on which the siderail assembly may be coupled.

15 Claims, 5 Drawing Sheets

(56) References Cited

U.S. PATENT DOCUMENTS 3,021,534 A 2/1962 Hausted
3,055,020 A 9/1962 Mann
3,100,129 A 8/1963 Adolphson
3,179,957 A 4/1965 Norton
3,220,024 A 11/1965 Nelson
3,249,387 A 5/1966 Pivacek
3,286,283 A 11/1966 Bertoldo
3,312,986 A 4/1967 Fahrni et al.
3,318,596 A 5/1967 Herzog
3,344,445 A 10/1967 Crawford
3,351,962 A 11/1967 Dodrill et al.
3,486,176 A 12/1969 Murcott
3,585,659 A 6/1971 Burst et al.
3,747,133 A 7/1973 Hutt
3,865,434 A 2/1975 Sully
3,932,903 A 1/1976 Adams et al.
3,971,083 A 7/1976 Peterson
4,002,330 A 1/1977 Johansson
4,105,242 A 8/1978 Terbeek
4,119,342 A 10/1978 Jones
4,120,530 A 10/1978 Imbro
4,221,370 A 9/1980 Redwine
4,277,100 A 7/1981 Beougher
4,417,361 A 11/1983 Smith
4,426,071 A 1/1984 Klevstad
4,439,880 A 4/1984 Koncelik et al.
4,541,622 A 9/1985 Tabuchi
4,612,679 A * 9/1986 Mitchell ..... 5/425
4,626,016 A 12/1986 Bergsten
4,632,450 A 12/1986 Holdt
4,680,790 A 7/1987 Packard et al.
4,691,962 A 9/1987 Holdt
4,703,975 A 11/1987 Roberts et al.
4,715,592 A 12/1987 Lewis
4,747,171 A 5/1988 Einsele et al.
4,795,214 A 1/1989 Holdt
4,839,933 A 6/1989 Plewright et al.
4,932,090 A 6/1990 Johansson
4,959,878 A 10/1990 Essek
4,993,089 A 2/1991 Solomon et al.
5,038,430 A 8/1991 Bly
5,060,327 A 10/1991 Celestina et al.
5,069,465 A 12/1991 Stryker et al.
5,083,430 A 1/1992 Hirata et al.
5,084,925 A 2/1992 Cook
5,195,200 A 3/1993 Leoutsakos
D336,578 S 6/1993 Celestina
5,216,768 A 6/1993 Bodine et al.
5,225,403 A 7/1993 Treiber et al.
5,231,721 A 8/1993 Fish
5,255,403 A 10/1993 Ortiz
5,333,887 A 8/1994 Luther
5,335,385 A 8/1994 Brown
5,337,430 A 8/1994 Schlein
5,347,682 A 9/1994 Edgerton, Jr.
5,381,571 A * 1/1995 Gabhart ..... 5/430
5,384,927 A 1/1995 Mardero et al.
5,388,294 A 2/1995 Reeder
5,394,581 A 3/1995 Leoutsakos
5,418,988 A 5/1995 Iura
5,433,235 A 7/1995 Miric et al.
5,463,784 A 11/1995 Alpern
5,471,689 A 12/1995 Shaw et al.
5,485,699 A 1/1996 Gabhart
5,542,136 A 8/1996 Tappel
5,542,138 A 8/1996 Williams et al.
5,586,352 A 12/1996 O'Brien et al.
5,659,910 A 8/1997 Weiss
5,678,267 A 10/1997 Kinder
5,680,661 A 10/1997 Foster et al.
5,689,839 A 11/1997 Laganiere et al.
5,715,548 A 2/1998 Weismiller et al.
5,781,945 A * 7/1998 Scherer et al. ..... 5/426
5,787,530 A 8/1998 Brix
5,802,636 A 9/1998 Corbin et al.
5,806,111 A 9/1998 Heimbrock et al.
5,832,549 A 11/1998 Le Pallec et al.
5,836,026 A 11/1998 Reed
5,842,237 A 12/1998 Hargest et al.
5,878,452 A 3/1999 Brooke et al.
6,009,570 A 1/2000 Hargest et al.
6,021,533 A 2/2000 Ellis et al.
6,058,531 A 5/2000 Carroll
6,076,209 A 6/2000 Paul
6,089,593 A 7/2000 Hanson et al.
6,101,678 A 8/2000 Malloy et al.
6,154,899 A 12/2000 Brooke et al.
6,163,903 A 12/2000 Weismiller et al.
6,182,310 B1 2/2001 Weismiller et al.
6,185,767 B1 2/2001 Brooke et al.
6,185,769 B1 2/2001 Larisey, Jr. et al.
6,212,714 B1 4/2001 Allen et al.
6,240,583 B1 6/2001 Brooke et al.
6,289,537 B1 9/2001 Hopper et al.
6,315,319 B1 11/2001 Hanson et al.
6,336,235 B1 1/2002 Ruehl
6,374,436 B1 4/2002 Foster et al.
D458,481 S 6/2002 Brooke
D459,119 S 6/2002 Brooke
6,397,416 B2 6/2002 Brooke et al.
6,427,264 B1 8/2002 Metz et al.
6,446,287 B2 9/2002 Borders
6,496,993 B2 12/2002 Allen et al.
6,565,112 B2 5/2003 Hanson et al.
6,668,402 B2 12/2003 Heimbrock
6,675,418 B1 1/2004 Armstrong
6,684,427 B2 2/2004 Allen et al.
6,691,350 B2 2/2004 Weismiller
6,694,548 B2 2/2004 Foster et al.
6,704,954 B2 3/2004 Metz et al.
6,725,474 B2 4/2004 Foster et al.
6,726,279 B1 4/2004 Figel et al.
6,728,985 B2 5/2004 Brooke et al.
6,789,280 B1 9/2004 Paul
6,817,363 B2 11/2004 Biondo et al.
6,820,293 B2 11/2004 Alverson
6,829,793 B2 * 12/2004 Brooke et al. ..... 5/425
6,846,042 B2 1/2005 Hanson et al.
6,860,281 B1 3/2005 Clift
6,874,179 B2 * 4/2005 Hensley et al. ..... 5/425
6,948,202 B2 9/2005 Weismiller
6,961,972 B2 11/2005 Pendell
6,978,499 B2 12/2005 Gallant et al.
7,000,272 B2 2/2006 Allen et al.
7,017,208 B2 3/2006 Weismiller et al.
7,020,920 B2 4/2006 Armstrong
7,028,354 B2 4/2006 Nygren et al.
7,032,265 B2 4/2006 Miller
7,039,971 B2 5/2006 Sebastien
7,073,220 B2 7/2006 Simmonds et al.
7,076,818 B2 7/2006 Kummer et al.
7,107,636 B2 9/2006 Metz et al.
7,150,058 B2 12/2006 Rabska et al.
D535,544 S 1/2007 DeBraal et al.
7,171,709 B2 2/2007 Weismiller
7,213,279 B2 5/2007 Weismiller et al.
7,216,384 B2 5/2007 Allen et al.
7,234,182 B2 * 6/2007 Miller et al. ..... 5/662
7,237,287 B2 7/2007 Weismiller et al.
7,243,386 B2 7/2007 Gallant et al.
7,325,265 B2 2/2008 Hornbach et al.
7,343,916 B2 3/2008 Biondo et al.
7,350,248 B2 4/2008 Hensley et al.
7,406,729 B2 8/2008 Hornbach et al.
7,430,771 B2 10/2008 Heimbrock
7,452,032 B1 11/2008 Roleder et al.
7,458,119 B2 12/2008 Hornbach et al.
7,472,445 B2 1/2009 Miller
7,480,951 B2 1/2009 Weismiller et al.
7,512,998 B2 4/2009 Martin et al.
7,523,515 B2 4/2009 Allen et al.
7,536,738 B2 5/2009 Richards et al.
7,568,246 B2 8/2009 Weismiller et al.
7,568,249 B1 8/2009 Kunde et al.

(56) References Cited

U.S. PATENT DOCUMENTS

| | | | |
|---|---|---|---|
| 7,600,817 | B2 | 10/2009 | Kramer et al. |
| 7,636,966 | B2 | 12/2009 | Gallant et al. |
| 7,665,166 | B2 | 2/2010 | Martin et al. |
| 7,676,862 | B2 | 3/2010 | Poulos et al. |
| 7,690,059 | B2 | 4/2010 | Lemire et al. |
| 7,703,158 | B2 | 4/2010 | Wilker, Jr. et al. |
| 7,730,562 | B2 | 6/2010 | Hornbach et al. |
| 7,743,441 | B2 | 6/2010 | Poulos et al. |
| 7,757,318 | B2 | 7/2010 | Poulos et al. |
| 7,774,873 | B2 | 8/2010 | Martin et al. |
| 7,779,494 | B2 | 8/2010 | Poulos et al. |
| 7,784,128 | B2 | 8/2010 | Kramer |
| 7,788,748 | B2 | 9/2010 | Wurdeman |
| 7,805,784 | B2 | 10/2010 | Lemire et al. |
| 7,805,789 | B1 | 10/2010 | Dean |
| 7,861,334 | B2 | 1/2011 | Lemire et al. |
| 8,322,342 | B2 | 12/2012 | Soto et al. |
| 2001/0027578 | A1 | 10/2001 | Brooke et al. |
| 2002/0002742 | A1 | 1/2002 | Osborne et al. |
| 2002/0095728 | A1 | 7/2002 | Weismiller |
| 2003/0024048 | A1 | 2/2003 | Heimbrock |
| 2003/0056293 | A1 | 3/2003 | Brooke et al. |
| 2003/0167568 | A1 | 9/2003 | Brooke |
| 2004/0158923 | A1* | 8/2004 | Perez et al. ..... 5/425 |
| 2004/0168254 | A1 | 9/2004 | Rabska et al. |
| 2005/0015879 | A1 | 1/2005 | Cuschieri et al. |
| 2005/0120485 | A1 | 6/2005 | Sebastien |
| 2006/0085914 | A1 | 4/2006 | Peterson et al. |
| 2006/0130238 | A1 | 6/2006 | Smith |
| 2006/0130239 | A1 | 6/2006 | Smith |
| 2006/0168727 | A1 | 8/2006 | Heimbrock |
| 2007/0151032 | A1 | 7/2007 | Heavrin |
| 2009/0007332 | A1 | 1/2009 | Wu et al. |
| 2009/0199339 | A1 | 8/2009 | Barr |
| 2009/0229049 | A1 | 9/2009 | Heimbrock et al. |
| 2010/0000016 | A1 | 1/2010 | Aiken et al. |
| 2010/0242176 | A1 | 9/2010 | Newkirk et al. |
| 2011/0185507 | A1 | 8/2011 | Abernathey et al. |
| 2012/0073051 | A1 | 3/2012 | Lachenbruch et al. |

FOREIGN PATENT DOCUMENTS

| | | |
|---|---|---|
| WO | WO 82/02832 | 9/1982 |
| WO | WO 01/47340 | 7/2001 |
| WO | WO 03/015686 | 2/2003 |
| WO | WO 03/032777 | 4/2003 |
| WO | WO 2006025245 | 3/2006 |
| WO | WO 2006/058506 | 6/2006 |

* cited by examiner

SIDERAIL ASSEMBLY FOR PATIENT SUPPORT APPARATUS

This application claims priority under 35 U.S.C. §119(e) to U.S. Provisional Application Ser. No. 61/369,324, filed Jul. 30, 2010, which is expressly incorporated by reference herein.

BACKGROUND

The present disclosure is related to a support apparatus for supporting a patient. More particularly, the present disclosure relates to a bed that can be manipulated to achieve both a conventional bed position having a horizontal support surface and a chair position having the feet of the patient on or adjacent to the floor and the head and back of the patient supported above a seat formed by the bed.

It is known to provide beds that have a head siderail assembly coupled to a head portion of the support surface and a foot siderail assembly coupled to a seat portion of the support surface. The siderail assemblies may be movable independently of one another between a raised position and a lowered position. The siderail assemblies may be used in the raised position to retain patients resting on the support surface and in the lowered position to transfer patients from the bed to another support apparatus, allow a caregiver improved access to the patient, or to help with entering and exiting the bed.

It is also known that patients egress from a side of the bed. Before the patient is able to egress, the patient must rotate the patient's body on the support surface to face toward the side, swing the patient's legs over the side of the bed, and remain sitting in an upright position without support from the support surface to the patient's back. Such coordinated movement to egress from the side of the bed may be difficult for some patients. As a result, egress from the chair position of the bed may be more suitable to some patients. With the bed in the chair position, the patient begins with the patient's feet resting on the floor, the patient sitting in the upright position, and the patient's back being supported by the support surface. To egress from the bed, the patient supports a portion of the patient's weight on the support surface on each side of the patient or on a caregiver standing next to the bed. The patient then leans forward and transfers the remaining weight to the patient's feet.

SUMMARY

This application discloses one or more of the features recited in the appended claims and/or the following features which, alone or in any combination, may comprise patentable subject matter.

According to one aspect of the present disclosure, a siderail assembly for a patient support apparatus includes a guide, a support, a barrier, and a handle. The guide mounts to a frame of the patient support apparatus and the support is coupled to the guide to move relative to the guide. The barrier is coupled to the support to pivot about a generally horizontal axis between a raised position and a lowered position. The barrier includes an outward side that face away from a patient support apparatus and an inward side that faces toward a deck included in a patient support apparatus. The handle is coupled to the barrier to move relative to the barrier between a first position and second position. When the handle is in the first position, the handle lies in a generally vertical plane with the barrier. When the handle is in the second position, the handle extends away from the inward side of the barrier.

In some embodiments, the handle moves about a pivot axis from the first position to the second position. The pivot axis may be at angle relative to the horizontal. The angle may also be greater than about zero degrees and less than about 90 degrees. In some embodiments, the angle is about 90 degrees. The angle may also be about 60 degrees.

The handle may be formed to include an aperture. The aperture may be configured to receive a patient's hand therein.

In some embodiments, the siderail assembly further includes a handle lock. The handle lock may be coupled to the barrier to move therewith. The handle lock may be movable between a locked position and a freed position. When the handle lock is in the unlocked position, the handle may be retained in place. When the handle lock is in the freed position, the handle may be free to move relative to the barrier. The handle lock may include a plunger, a receiver, and a bias spring. The plunger may be coupled to the barrier to move relative to the barrier. The receiver may be formed in the handle and configured to mate with the plunger when the handle lock is in the locked position. The bias spring may be coupled to the plunger to provide a bias force to the plunger to urge the plunger to mate with the receiver.

The handle lock may further include an actuator button. The actuator button may be coupled to the barrier to move back and forth in a lateral direction relative the barrier panel. The actuator button may be configured to apply an actuation force to the plunger to overcome the bias force and move the plunger from the locked position to the freed position.

In another aspect of the present disclosure, a siderail assembly for a patient support apparatus includes a linkage, a barrier, and a handle. The linkage mounts to a side of a patient support apparatus and the side extends between a foot and a head end of the patient support apparatus. The barrier is coupled to the linkage to move between a raised position and a lowered position. The barrier includes an outward side, an inward side arranged to face opposite the outward side, a head end, and an opposite foot end. The handle is coupled to the barrier to pivot about a pivot axis relative to the barrier between a first position and a second position. The handle when in the first position extends away from the foot end toward the head end and cooperates with the barrier to define a first length. The handle when in the second position extends away from the inward side of the barrier and cooperates with the barrier to define a second length. The first and the second lengths may be about equal to one another.

In some embodiments, the outward side of the barrier is formed to include a recess. The handle may be configured to mate with and positioned to lie in the recess when the handle is in the first position.

The handle may include a first side and an oppositely facing second side. The first side of the handle may face the barrier when the handle is in the first position. The second side of the handle may lie in generally coplanar relation with the outward side of the barrier when the handle is in the first position. The first and second sides of the handle may lie in generally perpendicular relation with the inward side of the barrier when the handle is in the second position. The handle may be movable to a third position in which the handle extends away from a foot end of the barrier. The handle may cooperate with the barrier to define a third length and the third length may be longer than the first and second lengths.

The pivot axis and the ground may cooperate to define an acute angle.

In another aspect of the present disclosure, a siderail assembly for a patient support apparatus includes a guide, a support, a barrier, and a handle. The guide is coupled to the frame in a fixed position. The support is coupled to the guide to move relative to the guide. The barrier is coupled to the support to pivot about an axis between a raised and a lowered position. The barrier includes an outward side and an oppositely facing inward side that is adapted to face toward a deck. The barrier further includes a head end and a foot end. The handle is coupled to the foot end of the barrier to pivot about a pivot axis relative to the barrier between a first position and a second position. The handle, when in the first position, extends in a longitudinal direction away from the foot end of the barrier. The handle, when in the second position, extends in a lateral direction away from the inward side of the barrier.

In some embodiments, the siderail assembly further includes a user interface that is coupled to the handle to move therewith. The user interface may be coupled electrically to a bed controller to control movement of the patient support apparatus in response to the first input.

The siderail assembly may further include a sensor. The sensor may be configured to sense a position of the handle relative to the barrier. The sensor may be coupled to the bed controller and configured to send a second input to the bed controller. The bed controller may control movement of the patient support apparatus in response to the second input.

Additional features alone or in combination with any other feature(s), including those listed above, those listed in the claims, and those described in detail below, may comprise patentable subject matter. Other features will become apparent to those skilled in the art upon consideration of the following detailed description of illustrative embodiments exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1:
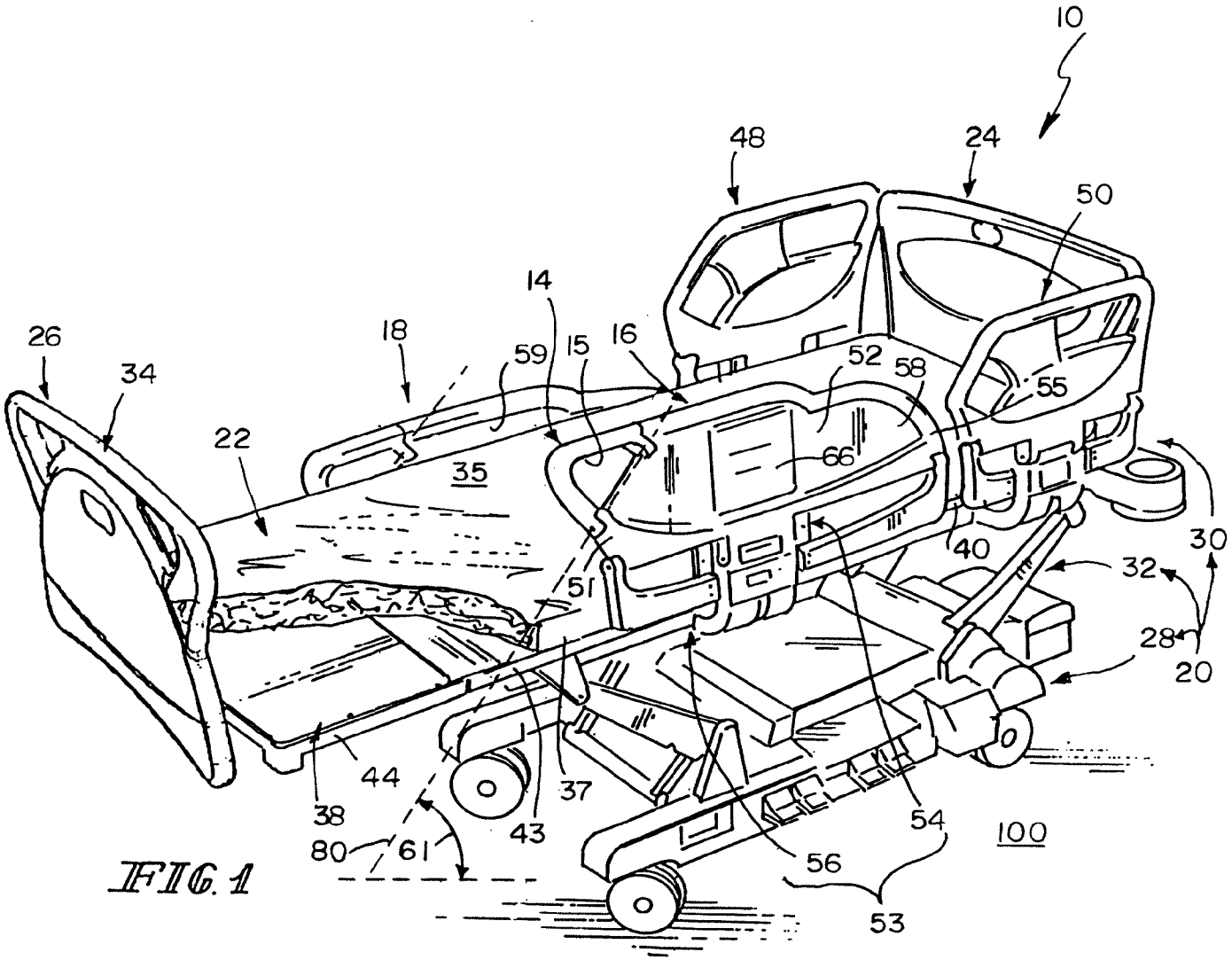
FIG. 1 is a perspective view of a patient support apparatus including three siderails in a raised position and a siderail in the lowered position.
Figure 2:
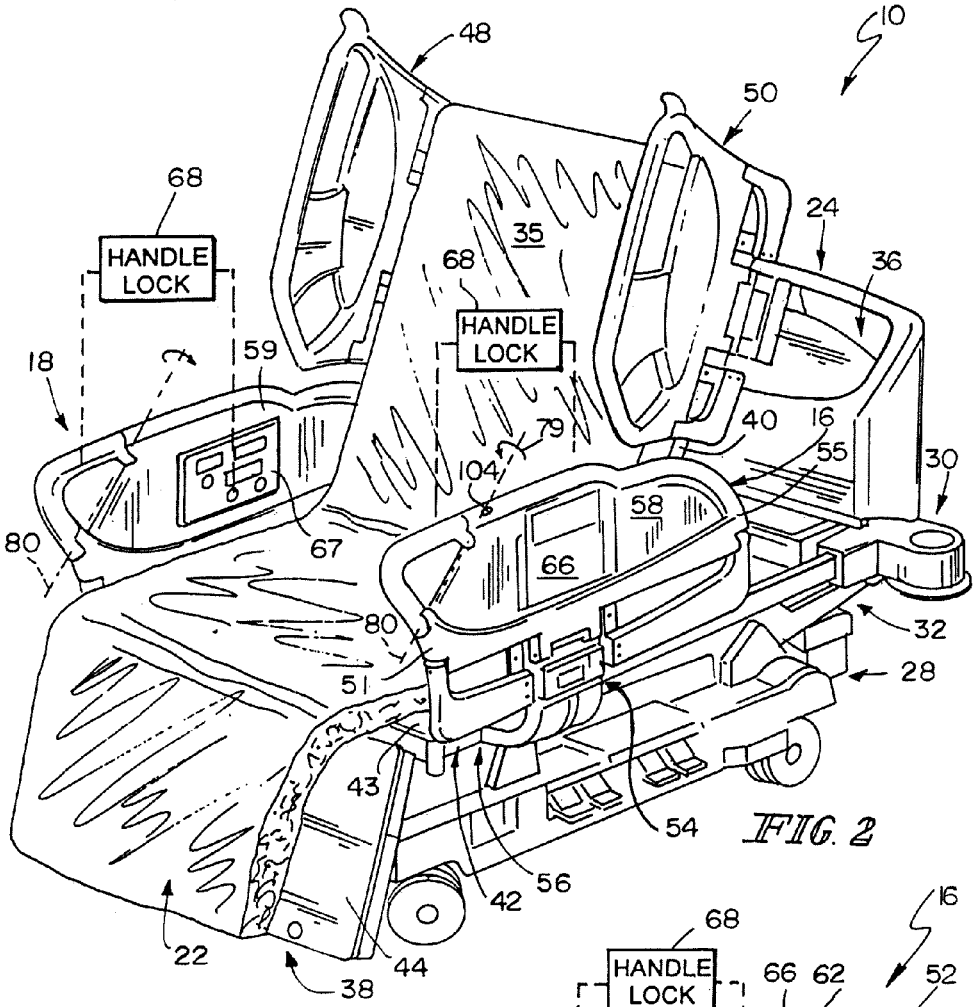
FIG. 2 is a perspective view of the patient support apparatus of FIG. 1 with each foot siderail including a handle in a first position.

According to the present disclosure, a patient support apparatus, such as an illustrative hospital bed 10 is shown, for example, in FIGS. 1 and 2. The hospital bed 10 may be arranged to assume a bed position, as shown in FIG. 1, and a chair-egress position as shown in FIG. 2. The hospital bed 10, when in the bed position, provides support to a patient (not shown) such that the patient's feet are supported spaced-apart from the ground 100. The hospital bed 10, when in the chair-egress position, supports the patient in an upright position such that the patient sits with the patient's feet positioned on the ground 100. The chair-egress position is also used by patients and caregivers to help patients egress or exit the hospital bed 10. As an example, a movable handle 14 included in each of the foot siderail assemblies 16, 18 is movable between a first position, shown in FIG. 2, and a second position shown in FIG. 3. In the second position, a patient may support his or her weight on the handles during egress from the hospital bed 10.

The hospital bed 10 includes a frame 20 and a mattress 22 that is supported by the frame 20 as shown in FIGS. 1 and 2. The bed 10 has a head end 24 and a foot end 26. The frame 20 includes a base 28 and an upper frame 30 coupled to the base 28 by an elevation system 32. The elevation system 32 is operable to raise, lower, and tilt the upper frame 30 relative to the base 28. The hospital bed 10 further includes a footboard 34 at the foot end 26 and a headboard 36 at the head end 24. Footboard 34 is removed prior to the bed 10 being moved into the chair-egress position shown in FIG. 2.

The hospital bed 10 includes four siderail assemblies coupled to the upper frame 30: a patient-right head siderail assembly 48, the patient-right foot siderail assembly 18, a patient-left head siderail assembly 50, and a patient-left foot siderail assembly 16. Each of the siderail assemblies 16, 18, 48, and 50 is movable between a raised position, as the left foot siderail assembly 16 is shown in FIG. 1, and a lowered position as the right foot siderail assembly 18 is shown in FIG. 1. Siderail assemblies 16, 18, 48, and 50 are sometimes referred to as siderails 16, 18, 48, 50 herein.

The left foot siderail 16 is similar to the right foot siderail 18, and thus, the following discussion of the left foot siderail 16 is equally applicable to the right foot siderail 18. The left foot siderail 16 includes a barrier panel 52 and a linkage 53 that comprises a support assembly 54 and a guide assembly 56. The guide assembly 56 is coupled to the upper frame 30 in a fixed position and is configured to guide the support assembly 54 and the barrier panel 52 during movement of the foot siderail 16 between the raised and the lowered positions. The support assembly 54 interconnects the barrier panel 52 and the guide assembly 56 to cause the barrier panel 52 to remain in a substantially vertical orientation during movement between the raised and the lowered positions.

The barrier panel 52 includes an outward side 58, an oppositely facing inward side 59, a top portion 62, and a bottom portion 64. The outward side 58 faces away from the frame 20. A first user interface 66 is coupled to the outward side 58 of the barrier panel 52 for use by a caregiver (not shown). As shown in FIG. 2, a second user interface 67 is coupled to the inward side 59 for use by a patient (not shown). The top portion 62 extends in an upward direction away from the frame 20 while the bottom portion 64 extends opposite the top portion 62 and is coupled to the support assembly 54 for pivoting movement relative to the support assembly 54. The barrier panel 52 also includes a foot end 51 and an opposite head end 55 as shown in FIG. 2.

The mattress 22 includes a top surface 35, a bottom surface (not shown), and a perimeter surface 37 as shown in FIGS. 1 and 2. The upper frame 30 of the frame 20 carries a patient-support deck 38 that engages the bottom surface of mattress 22. The patient-support deck 38, as shown in FIG. 1, includes a head section 40, a seat section 42, a thigh section 43, and a foot section 44. For example, head section 40 pivotably raises and lowers relative to the thigh section 43. Additionally, the thigh section 43 pivotably raises and lowers relative to the seat section 42. Also, the foot section 44 is extendable and retractable to change an overall length of the foot section 44, and therefore, to change an overall length of the patient-support deck 38.

In some embodiments, the seat section 42 also moves, such as by translating on the upper frame 30 as the hospital bed 10 moves between the bed position and the chair-egress position. In those embodiments where the seat section 42 translates along the upper frame 30, the thigh and foot sections 43, 44 also translate along with the seat section 42. As bed 10 moves from the bed position to the chair-egress position, the foot section 44 lowers relative to the thigh section 43 and shortens in length. As the bed 10 moves from the chair-egress position to the bed position, the foot section 44 raises relative to the thigh section 43 and increases in length. Thus, in the chair-egress position, the head section 40 extends generally vertically upwardly from the upper frame 30 and the foot section 44 extends generally downwardly from the thigh section 43 as shown in FIG. 2.

Figure 3:
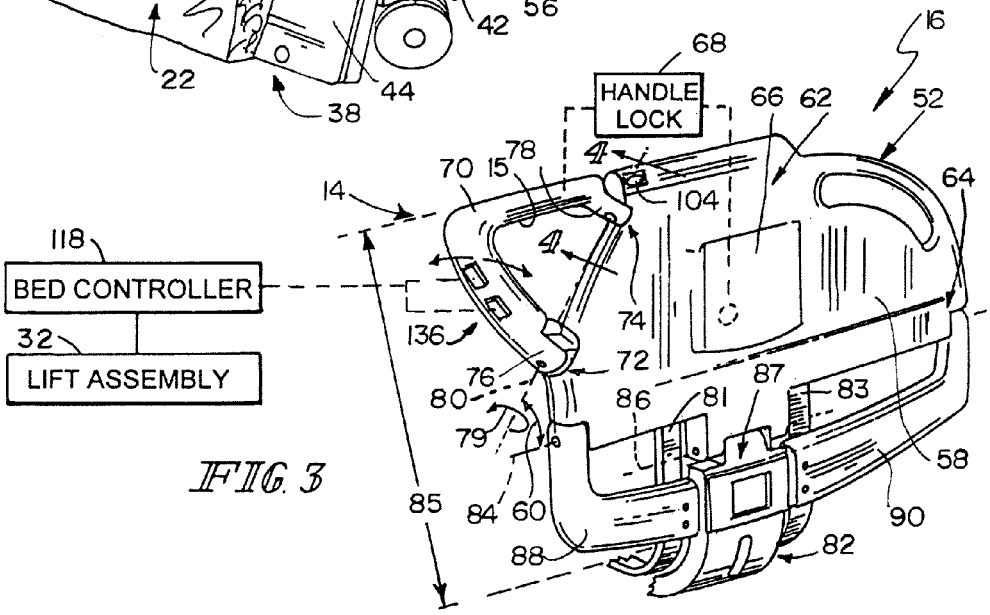
FIG. 3 is an enlarged partial perspective view of the right foot siderail of FIGS. 1 and 2 with the handle in the second position and a handle having a user interface.

The left foot siderail 16, as discussed previously, includes the barrier panel 52, the support assembly 54, and the guide assembly 56 as shown in FIGS. 1-3. The left foot siderail 16 further includes a handle 14 and a handle lock 68. The handle 14 is coupled to the barrier panel 52 to move selectively relative to the barrier panel 52 as shown in FIG. 3. As an example, a caregiver disengages the handle lock 68 to allow the handle 14 to pivot about a handle-pivot axis 80 between a first position, as shown in FIGS. 1 and 2, and a second position as shown in FIG. 3. After the handle 14 is freed, the handle 14 moves from the first position to the second position by pivoting about the handle-pivot axis 80 in a counter-clockwise direction 79 toward the patient-support deck 38. Once the handle 14 is in the second position, a caregiver allows the handle lock 68 to reengage so that unintended movement of the handle 14 relative to the barrier panel 52 is blocked.

The handle 14, when in the first position, acts as an extension of the barrier panel 52 so that egress of a patient resting in the hospital bed 10 is blocked. For example, the handle 14 is in the first position when the hospital bed 10 is in the bed position and in the chair-egress position as shown in FIGS. 1 and 2. Each handle 14 of both foot siderails 16, 18, when in the second position, extend toward one another to minimize a distance between the foot siderails 16, 18 so that a patient may grip the handles to support himself or herself during egress from the hospital bed 10. For example, the hospital bed 10 is moved from the bed position to the chair-egress position before the handles 14 are moved from the first position to the second position.

As shown in FIG. 3, the handle 14 is coupled to a foot end of the barrier panel 52. The handle 14 includes a handle body 70, a first handle joint 72, and a second handle joint 74. The handle body 70 includes a first end 76 and a second end 78 spaced-apart from the first end 76. The handle joints 72, 74 interconnect the handle body 70 to the barrier panel 52 to allow handle body 70 to pivot about the handle-pivot axis 80. The first end 76 of the handle 14 is coupled to first handle joint 72 and the second end 78 of the handle 14 is coupled to the second handle joint 74. As shown in FIG. 3, the handle body 70 is L-shaped and cooperates with the foot end of the barrier panel 52 to define an aperture 15 that receives a patient's hand therein.

As discussed previously, the left foot siderail 16 also includes the support assembly 54. The support assembly 54, embodied as a link mechanism, includes a first upper link 81, a second upper link 83, and a lower link 82 as shown in FIG. 3. The links 81, 82, and 83 interconnect a bottom portion 64 of the barrier panel 52 to the guide assembly 56 to cause the barrier panel 52 to pivot between the raised and lowered positions. The first and second upper links 81, 83 are coupled to the barrier panel 52 to cause the barrier panel 52 to pivot about a first generally horizontal pivot axis 84. The lower link 82 interconnects the barrier panel 52 and the guide assembly 56 to cause the barrier panel 52 to pivot about a second generally horizontal pivot axis 86. When the foot siderail 16 is in the raised position, the first pivot axis 84 is in a spaced-apart parallel relation above the second pivot axis 86. The first and second pivot axes 84, 86 lie generally in parallel relation to a longitudinal axis of the hospital bed 10 that extends between the head end 24 and the foot end 26 of the frame 20.

The support assembly 54 further includes a pair of barrier extenders 88, 90 as shown in FIGS. 1-3. The first barrier extender 88 is coupled to the barrier panel 52 to pivot about the first pivot axis 84 and is coupled to the first upper link 81 to move therewith. The second barrier extender 86 is coupled to the barrier panel 52 to pivot about the first pivot axis 84 and is coupled to the second upper link 83 to move therewith. The barrier extenders 88 and 90 cooperate with the outward side 58 of barrier panel 52 to establish an enlarged barrier surface having a raised height 85 when the foot siderail 16 is in the raised position. The barrier extenders 88, 90 pivot with the first and second upper links 81, 83 below the patient-support deck 38 to reduce the height of the foot siderail 16 when the foot siderail 16 is in the lowered position which is smaller than a raised height 85 of the left foot siderail 16 so that a distance defined between the patient-support deck 38 and the ground is minimized.

As illustrated in FIG. 3, the first and the second handle joints 72, 74 cooperate to define the handle-pivot axis 80. The handle-pivot axis 80 and the first pivot axis 84 define an included angle 60 therebetween. The angle 60 is about 60 degrees, but may be any angle less than about 90 degrees. The handle-pivot axis 80 also cooperates with the ground 100 to define an acute angle 61 there between. As an example, the acute angle 61 is about equal to the angle 60.

Figure 4:
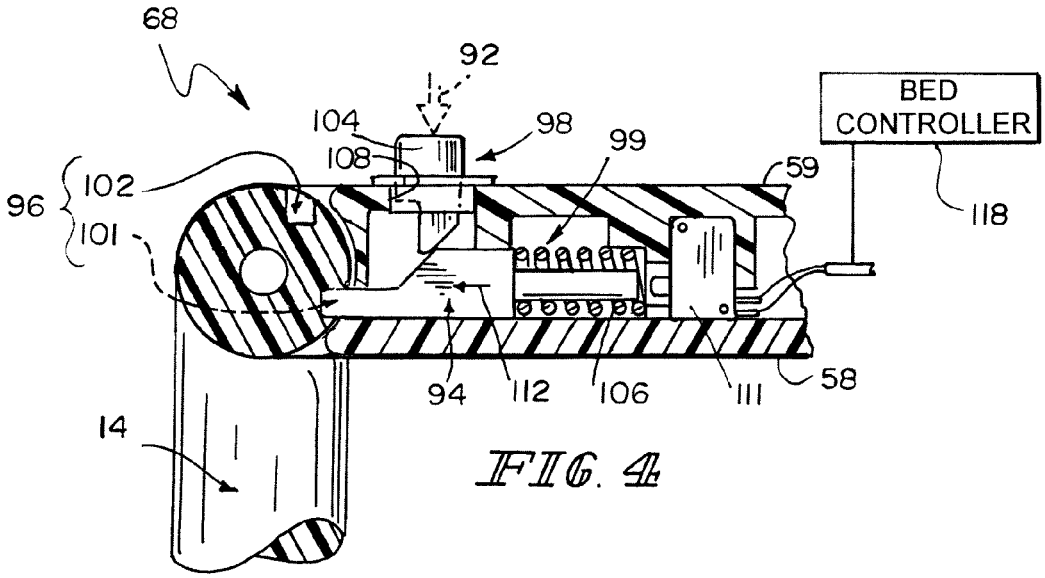
FIG. 4 is a sectional view taken along line 4-4 of FIG. 3 showing an illustrative handle lock in a locked position.
Figure 5:
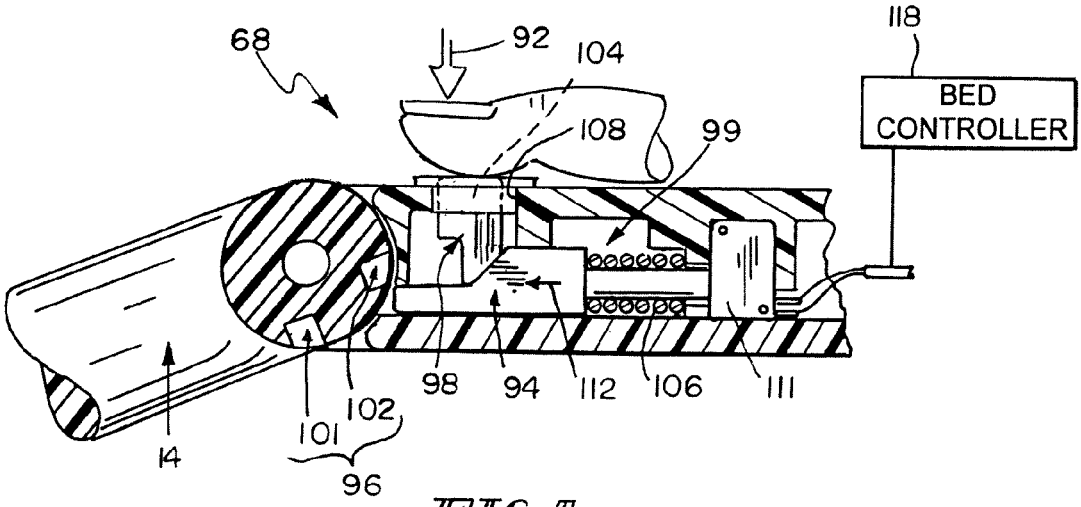
FIG. 5 is a view similar to FIG. 4 with the handle lock in the freed position.

The handle lock 68 included in the siderail 16 is movable between the locked position, as shown in FIG. 4, and the freed position, as shown in FIG. 5. The handle lock 68 blocks movement of the handle 14 relative to the barrier panel 52 when the handle lock 68 is in the locked position. The handle 14 is free to pivot about the handle-pivot axis 80 when the handle lock 68 is in the freed position. A caregiver applies an actuation force 92 to the handle lock 68 to cause the handle lock 68 to move from the locked position to the freed position as suggested in FIG. 4 and shown in FIG. 5.

The handle lock 68 includes a plunger 94, a receiver 96, and an actuator 98 as shown in FIGS. 4 and 5. The plunger 94 lies in a space 99 formed in the barrier panel 52 and mates with the receiver 96 when the handle lock 68 is in the locked position and is spaced-apart from the receiver 96 when the handle lock 68 is in the freed position. Receiver 96 includes a pair of slots 101, 102 formed in the first end 76 of the handle 14. As shown in FIG. 4, the first slot 101 is at about the four o'clock position and is associated with the handle 14 being in the second position. The second slot 102 is in about the two o'clock position and is associated with the handle 14 being in the first position. The actuator 98 is coupled to the outward side 58 of the barrier panel 52 and moves back-and-forth relative to the barrier panel 52 to engage and move the plunger 94.

The actuator 98 of handle lock 68 includes an actuator button 104 and a bias spring 106. The actuator button 104 extends through an aperture 108 formed in the barrier panel 52 that opens into the space 99. The bias spring 106 is coupled the barrier panel 52 and to the plunger 94. The bias spring 106 provides a bias force 112 to the plunger 94 that urges the plunger to mate with the receiver 96.

A caregiver uses the actuator button 104 to apply an actuation force 92 to the plunger 94 to overcome the bias force 112 and urge the plunger away from the receiver 96. After the plunger 94 has moved away from the receiver 96, handle 14 may move between the first position and the second position. After the caregiver removes the actuation force 92, the plunger 94 mates with the receiver 96 when the handle 14 moves to either the first position or the second position.

As shown in FIGS. 4 and 5, the handle 14 includes a position sensor 111. The position sensor 111 is coupled electronically to a bed controller 118 also included in the hospital bed 10. As shown in FIGS. 4 and 5, the position sensor 111 senses the position of the plunger 94 relative to the barrier panel 52. The position of the handle 14 is determined as a result of first slot 101 being deeper than second slot 102. Thus, position sensor 111 is able to sense when handle 14 is in the first position, the second position, and when the handle lock 68 is in the locked position or the freed position.

The position sensor 111 is coupled to the bed controller 118 to communicate the position of the handle 14 to the bed controller 118. The bed controller 118 is coupled electrically to the elevation system 32 to control vertical movement of the upper frame 30 relative to the base 28. The bed controller 118 also controls movement of the hospital bed 10 between the bed position and the chair-egress position. As a result of the bed controller 118 being coupled to the position sensor 111, the bed controller 118 may block movement of the thigh section 43 when the handle 14 is in the second position so as to minimize damage to the foot siderails 16, 18.

In other illustrative embodiments, the handle lock may be a Porter Group, LLC. MECHLOK® brand locking mechanism. The locking mechanism may be either actuated by a caregiver applying a manual actuation force or the actuation force may be provided by a powered actuator included in the hospital bed 10. The powered actuator may be coupled to the bed controller and configured to respond to commands sent by the bed controller. A user may disengage the handle lock to free the handles 14 to move to the second position by using one of the user interfaces 66, 67 to send an input to the controller to cause the powered actuator to provide the actuation force to the locking mechanism.

The handle 14 also includes another user interface 136 that is coupled electrically to the bed controller 118 as shown in FIG. 3. The bed controller is coupled electrically to the elevation system 32 to control movement of the upper frame 30 relative to the base 28 in response to inputs received from user interface 136. As an example, a patient may use the user interface 136 to move the hospital bed 10 from the chair-egress position to the bed position. The patient may also cause the bed 10 to move from the chair-egress position to an egress-lift position in which the patient-support deck 38 is arranged in the chair-egress position, but the elevation system 32 tilts a head end of the upper frame 30 and the patient-support deck 38 upwardly to aid the patient during egress from the hospital bed 10. While the user interface 136 is shown with the handle 14 in FIG. 3, the user interface 136 may be used with any of the handles disclosed herein.

The left foot siderail 16 also illustratively includes at least one latching mechanism 87, as shown in FIGS. 1-3. The latching mechanism 87 releasably secures a portion of the foot siderail assembly 16, 18 to the frame 20 of the patient support apparatus. The latching mechanism 87 may releasably secure the barrier panel 52 in one or more positions. As an example, the latching mechanism 87 secures the barrier panel 52 in the raised position to block movement of the barrier panel 52 from the raised position to the lowered position. The latching mechanism may releasably secure a barrier panel with a support assembly, releasably secure the support assembly with the frame of the patient support apparatus, and releasably secure the support assembly with the guide assembly.

Figure 6:
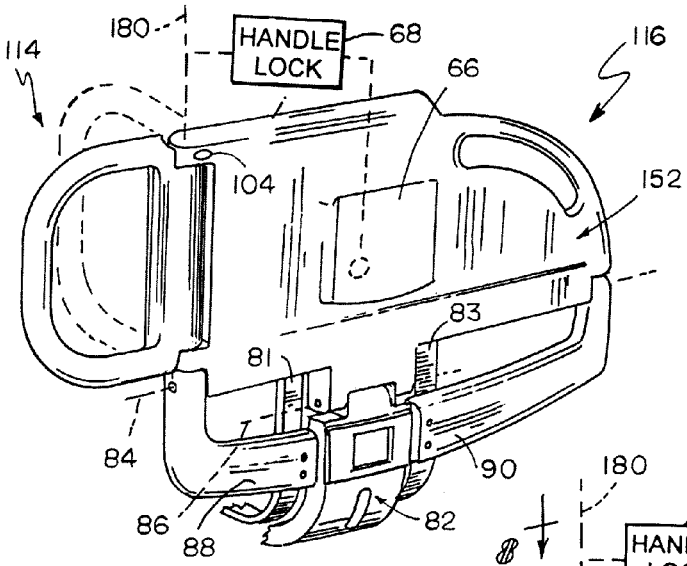
FIG. 6 is an enlarged partial perspective view of another embodiment of a right foot siderail with the handle in a first position.
Figure 7:
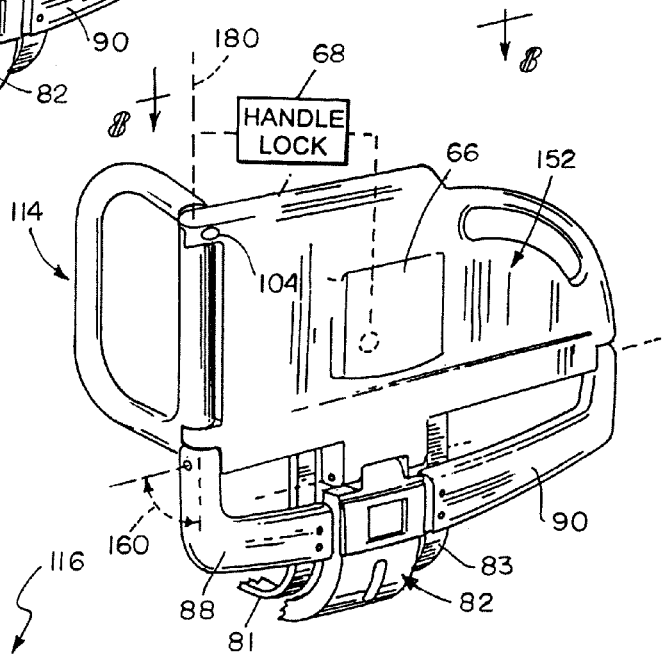
FIG. 7 is view similar to FIG. 6 with the handle in the second position.
Figure 8:
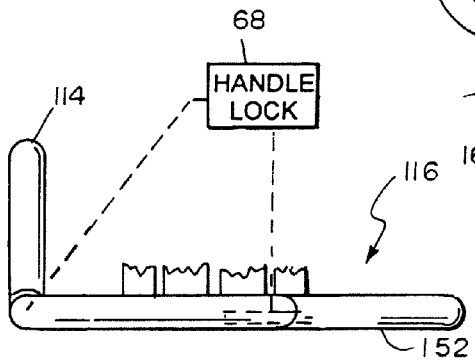
FIG. 8 is a plan view taken along line 8-8 of FIG. 7.

Another embodiment of a left foot siderail assembly 116 is shown in FIG. 6. The left foot siderail assembly 16 is omitted from the hospital bed 110 and replaced with the left foot siderail 116. The left foot siderail 116 includes a handle 114 coupled to the foot end of the barrier panel 152 to move between a first position shown in FIG. 6 and an second position shown in FIGS. 7 and 8. The handle 114 pivots about a handle-pivot axis 180 that is substantially vertical and perpendicular to the first pivot axis 84 discussed previously. An angle 160 is formed between handle-pivot axis 180 and first pivot axis 84 that is about 90 degrees.

Figure 9:
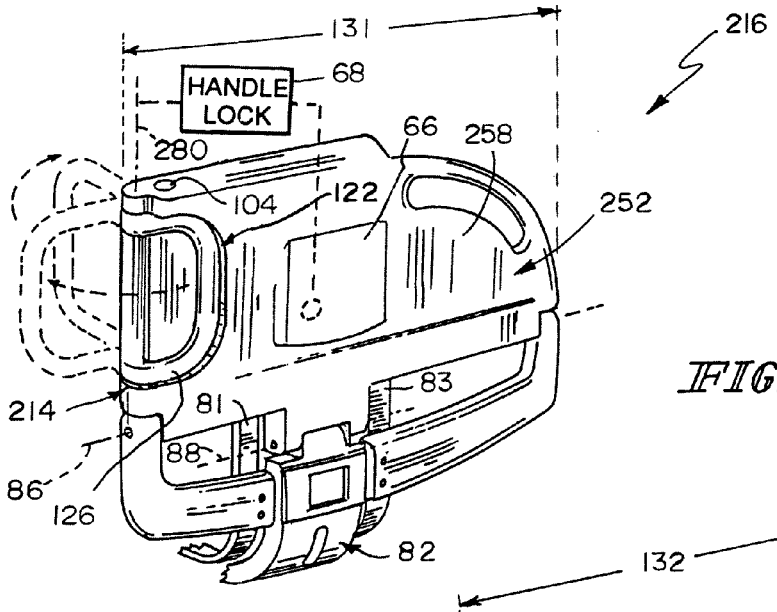
FIG. 9 is an enlarged partial perspective view of another embodiment of a right foot siderail with the handle in a first position.
Figure 10:
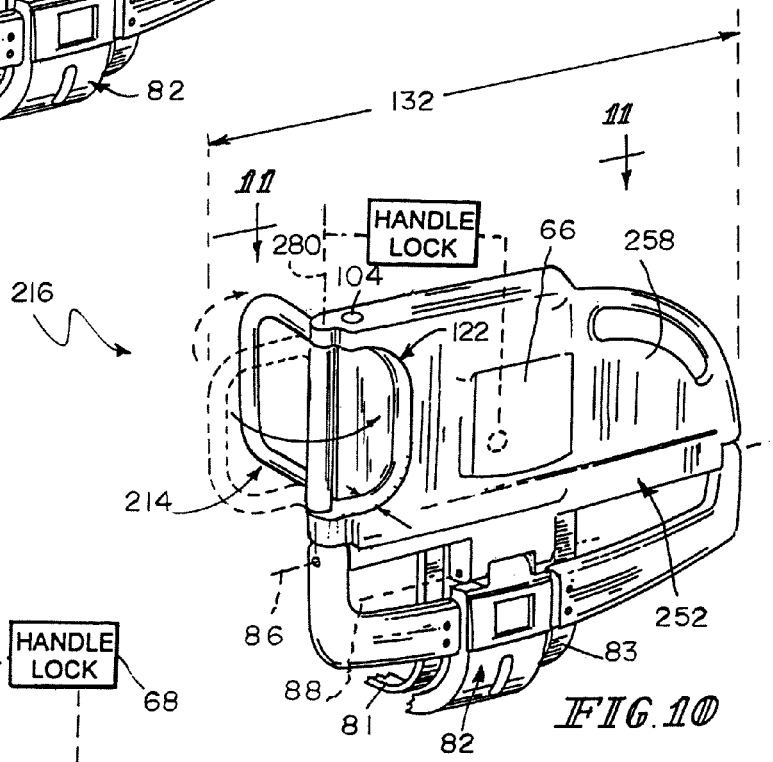
FIG. 10 is a view similar to FIG. 9 with the handle in the second position.
Figure 11:
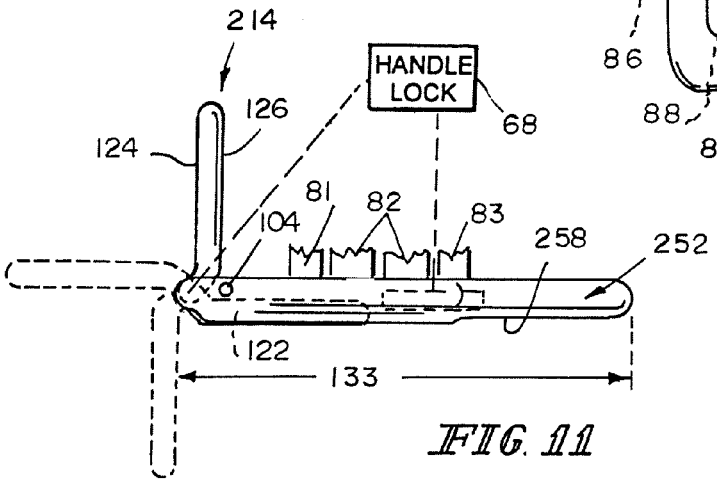
FIG. 11 is a plan view taken along line 11-11 of FIG. 10.

Another embodiment of a left foot siderail assembly 216 is shown in FIGS. 9-11. The left foot siderail assemblies 16, 116 are omitted from the hospital bed 110 and replaced with the left foot siderail 216. Left foot siderail 216 includes a handle 214 and a barrier panel 252. The handle 214, like the handle 114, is coupled to the foot end of the barrier panel 252 to move about a handle-pivot axis 280 between a first position shown in FIG. 9, a third position suggested in FIGS. 9-11, and an second position shown in FIGS. 10 and 11. The barrier panel 252 has a first length 131 when in the first position, a second length 132 when in the third position, and a third length 133 when in the second position. Siderail 216 differs from siderails 16, 116 in that the first length 131 is about equal to the third length 133, and the second length 132 is greater than first and third lengths 131, 133 as shown in FIGS. 9-11.

The handle 214, when in the first position, mates with a recess 122 formed in an outward side 258 of the barrier panel 252. The handle 214 includes a first side 124 and an oppositely facing second side 126. The first side 124 of the handle 214 faces the barrier panel 252 and the second side 126 of the handle 214 lies in coplanar relation with the outward side 258 of the barrier panel 252. The barrier panel 252 has the first length 131 when the handle 214 is in the first position as shown in FIG. 9

In use, a caregiver (not shown) moves handle lock 68, discussed previously, from the locked position to the freed position and then pivots the handle 214 in the counter-clockwise direction 79 to the third position (shown in phantom) as suggested in FIGS. 9 and 10. The handle 214, when in the third position, extends away from the head end 24 of the hospital bed 110 toward the foot end 26 of the hospital bed 110. The handle 214 and the barrier panel 252 cooperate to establish an enlarged barrier surface having the second length 132 when the handle 14 is in the third position, as suggested in FIG. 9. The second length 132 is larger than the first length 131.

In some embodiments, the siderail further includes an alert light that is coupled electrically to the bed controller to provide light when called upon by the bed controller. The alert light is coupled to the barrier panel to shine light on the handle. As an example, the bed controller activates the alert light when the hospital bed is in the chair-egress position to alert a patient or a caregiver that the handle is available for use. Thus, the alert light provides a reminder to users and helps patients use the handle when ambient room light is low.

Illustrative beds 10 and 110 are a so-called chair bed, in that they are movable between a bed position, as shown in FIG. 1, and a chair-egress position as shown in FIG. 2. However the teachings of this disclosure are applicable to all types of hospital beds, including those that are incapable of achieving a chair-egress position. Some hospital beds are only able to move into a chair-like position, sometimes referred to by those in the art as a "cardiac chair position," and this disclosure is equally applicable to those types of beds. Furthermore, the teachings of this disclosure are applicable to other types of patient support apparatuses such as stretchers, motorized chairs, operating room (OR) tables, specialty surgical tables such as orthopedic surgery tables, examination tables, and the like.

Although certain illustrative embodiments have been described in detail above, variations and modifications exist within the scope and spirit of this disclosure as described and as defined in the following claims.

The invention claimed is:

1. A siderail assembly for a patient support apparatus, the siderail assembly comprising a guide adapted for mounting to a frame of a patient support apparatus, a support coupled to the guide to move relative to the guide, a barrier coupled to the support to pivot about a generally longitudinal axis between a raised position and a lowered position, the barrier including an outward side adapted to face away from a patient support apparatus and an inward side adapted to face toward a mattress included in a patient support apparatus, and a handle coupled to the barrier to move relative to the barrier between a first position in which the handle is arranged to lie in a generally vertical plane with the barrier and a second position in which the handle is arranged to extend away from the inward side of the barrier, wherein the handle moves about a pivot axis from the first position to the second position, wherein the pivot axis is at an angle relative to the generally longitudinal axis, and wherein the angle is greater than about 0 degrees and less than about 90 degrees.

2. The siderail assembly of claim 1, wherein the angle is about 60 degrees.

3. The siderail assembly of claim 2, wherein the handle is formed to include an aperture adapted to receive a hand of a patient therein.

4. The siderail assembly of claim 1, wherein the siderail assembly further comprises a handle lock coupled to the barrier to move therewith and the handle lock is movable between a locked position in which the handle is retained in place and a freed position in which the handle is free to move relative to the barrier.

5. The siderail assembly of claim 4, wherein the handle lock includes a plunger coupled to the barrier to move relative to the barrier and a receiver formed in the handle and configured to mate with the plunger when the handle lock is in the locked position.

6. The siderail assembly of claim 5, wherein the handle lock further includes a bias spring coupled to the plunger to provide a bias force to the plunger to urge the plunger to mate with the receiver.

7. The siderail assembly of claim 6, wherein the handle lock further includes an actuator button coupled the barrier to move back and forth in a lateral direction relative to the barrier panel and configured to apply an actuation force to the plunger to overcome the bias force and move the plunger from the locked position to the freed position.

8. A siderail assembly for a patient support apparatus, the siderail assembly comprising a linkage adapted for mounting to a longitudinal side of a patient support apparatus, a barrier coupled to the linkage to move between a raised position and a lowered position about a generally longitudinal axis, the barrier including an outward side, an inward side arranged to face opposite the outward side, a head end, and an opposite foot end, and a handle coupled to the barrier to pivot about a pivot axis relative to the barrier between a first position in which the handle extends away from the foot end toward the head end and cooperates with the barrier to define a first length and a second position in which the handle extends away from the inward side of the barrier and cooperates with the barrier to define a second length, and wherein the first and second lengths are about equal, wherein the pivot axis is at an angle relative to the generally longitudinal axis and the angle is greater than about 0 degrees and less than about 90 degrees.

9. The siderail assembly of claim 8, wherein an acute angle is defined between the pivot axis and ground.

10. A siderail assembly for a patient support apparatus, the siderail assembly comprising a barrier coupled to the support to pivot about a generally longitudinal axis and a handle coupled to the barrier to move relative to the barrier about a pivot axis, wherein the pivot axis is at an angle relative to the generally longitudinal axis and the angle is greater than about 0 degrees and less than about 90 degrees.

11. The siderail assembly of claim 10, wherein the angle is about 60 degrees.

12. The siderail assembly of claim 11, wherein the handle is formed to include an aperture adapted to receive a hand of a patient therein.

13. The siderail assembly of claim 10, wherein the siderail assembly includes a user interface coupled to the handle to move therewith, the user interface is adapted to send a first input to a bed controller to control movement of the patient support apparatus in response to the first input.

14. The siderail assembly of claim 13, wherein the siderail assembly further comprises a sensor configured to sense a position of the handle relative to the barrier and the sensor is adapted to send a second input to a bed controller to control movement of the patient support apparatus in response to the second input.

15. The siderail assembly of claim 10, wherein the siderail assembly further comprises a handle lock coupled to the barrier to move therewith and the handle lock is movable between a locked position in which the handle is retained in place and a freed position in which the handle is free to move relative to the barrier.

* * * * *